US009554597B2

(12) United States Patent
Liu

(10) Patent No.: US 9,554,597 B2
(45) Date of Patent: Jan. 31, 2017

(54) ELECTRONIC CIGARETTE, ELECTRONIC CIGARETTE ATOMIZER, AND ELECTRONIC CIGARETTE-HOLDER

(71) Applicant: Qiuming Liu, Shenzhen (CN)

(72) Inventor: Qiuming Liu, Shenzhen (CN)

(73) Assignee: HUIZHOU KIMREE TECHNOLOGY CO., LTD. SHENZHEN BRANCH, Shenzhen (CN)

( * ) Notice: Subject to any disclaimer, the term of this patent is extended or adjusted under 35 U.S.C. 154(b) by 735 days.

(21) Appl. No.: 13/956,799

(22) Filed: Aug. 1, 2013

(65) Prior Publication Data

US 2015/0000683 A1 Jan. 1, 2015

(30) Foreign Application Priority Data

Jun. 26, 2013 (CN) ..... 2013 2 0388566 U

(51) Int. Cl.
*A24F 47/00* (2006.01)
*A24F 7/00* (2006.01)

(52) U.S. Cl.
CPC ..... *A24F 47/008* (2013.01); *A24F 7/00* (2013.01)

(58) Field of Classification Search
CPC ..... A24F 47/002; A24F 47/006; A61M 15/06
USPC ..... 131/329
See application file for complete search history.

(56) References Cited

U.S. PATENT DOCUMENTS

| | | | | |
|---|---|---|---|---|
| 3,030,964 | A * | 4/1962 | Whitmore | A24D 3/04 128/DIG. 8 |
| 3,490,462 | A * | 1/1970 | Martin | A24B 15/32 131/200 |
| 3,545,448 | A * | 12/1970 | Morman | A24B 15/165 131/369 |
| 4,182,743 | A * | 1/1980 | Rainer | B01D 53/72 131/334 |
| 7,762,267 | B2 * | 7/2010 | Schmidt | A24D 3/066 131/331 |
| 2006/0191546 | A1 * | 8/2006 | Takano | A24F 47/002 131/270 |

* cited by examiner

*Primary Examiner* — Joseph S Del Sole
*Assistant Examiner* — Mohamed K Ahmed Ali
(74) *Attorney, Agent, or Firm* — Tim Tingkang Xia, Esq.; Locke Lord LLP

(57) ABSTRACT

An electronic cigarette comprising a cigarette-holder is provided, the cigarette-holder includes a variable color material; and when the electronic cigarette is smoked, the variable color material generates a chemical reaction or a physical change and causes a color of the variable color material to change. Thereby whether the electronic cigarette has been smoked can be determined by observing the color change of the variable color material.

10 Claims, 3 Drawing Sheets

ELECTRONIC CIGARETTE, ELECTRONIC CIGARETTE ATOMIZER, AND ELECTRONIC CIGARETTE-HOLDER

CROSS-REFERENCE TO RELATED APPLICATIONS

This non-provisional application claims priorities under 35 U.S.C. §119(a) on Patent Application No. 201320388566.7 filed in P.R. China on Jun. 26, 2013, the entire contents of which are hereby incorporated by reference.

FIELD OF THE INVENTION

The present invention relates to the field of electrical heating technology, and more particularly, relates to an electronic cigarette, an electronic cigarette atomizer, and an electronic cigarette-holder.

BACKGROUND OF THE INVENTION

As a hobby, smoking attracts many persons, especially men. However, tar of cigarettes comprises dozens of kinds of carcinogenic ingredients and is harmful to human bodies. Furthermore, second-hand smoking does great harm to non-smokers. Therefore, most public places have bans on smoking. But it is difficult to stop smoking for a smoker. Thus, electronic cigarettes have been more and more widely used as a substitute for traditional tobacco.

An electronic cigarette is provided with a cigarette-holder. When a switch of the electronic cigarette is turned on, the electronic cigarette can be smoked via the cigarette-holder or an airflow sensor. The electronic cigarette can be put back into a cigarette box for the next use after it is smoked. However, a typical electronic cigarette that has not been smoked is not different from such an electronic cigarette that has been smoked, and thus it is difficult to determine whether such an electronic cigarette has been smoked or not. When a plurality of persons smoke electronic cigarettes stored in a same cigarette box, one of the electronic cigarettes may be shared by different users, which may adversely affect the users' health and become a transmission way of many diseases.

SUMMARY OF THE INVENTION

The objective of the present invention is to provide an electronic cigarette, an electronic cigarette atomizer, and an electronic cigarette-holder which can be used to determine whether the electronic cigarette has been smoked and prevent the electronic cigarette from being shared by more than one person, thereby overcoming the shortcoming that it is difficult to determine whether an electronic cigarette has been smoked in prior art.

The technical solutions of the present invention for solving the technical problems are as follows:

An electronic cigarette is provided, wherein, the electronic cigarette comprises a cigarette-holder; the cigarette-holder includes a variable color material; and when the electronic cigarette is smoked, the variable color material generates a chemical reaction or a physical change and causes a color of the variable color material to change. Advantageously, the variable color material forms a variable color layer, and the variable color layer forms patterns and/or words.

Advantageously, a thickness of the variable color layer ranges from 1 micron to 100 microns.

Advantageously, the variable color layer is formed by immersion, deposition, spraying or pasting.

Advantageously, the cigarette-holder includes a liquid guiding member configured to lead saliva to the variable color material, and one end of the liquid guiding member is in contact with the variable color material.

Advantageously, the liquid guiding member is made of at least one material selected from sponge, cotton, acetate fiber, and nonwoven fabric.

Advantageously, the variable color material is an inclusion generated by starch and iodine, and when the electronic cigarette is smoked, the starch in the inclusion is decomposed by the salivary amylase in the saliva and causes the color of the variable color material to change.

Advantageously, the variable color material is an inclusion generated by amylose and iodine, and the variable color material is blue; and when the electronic cigarette is smoked, the amylose of the variable color material is decomposed by the salivary amylase, and the blue variable color material becomes transparent.

Advantageously, the variable color material is an inclusion generated by amylopectin and iodine, and the variable color material is purple; and when the electronic cigarette is smoked, the amylopectin of the variable color material is decomposed by the salivary amylase, and the purple variable color material becomes transparent.

Advantageously, the variable color material is a colorful sugar, and the colorful sugar melts when the electronic cigarette is smoked.

Advantageously, the sugar is made up of at least one selected from maltose, stevioside, sucrose, and glucose.

Advantageously, the variable color material is litmus, and when the electronic cigarette is smoked, carbon dioxide exhaled by a user causes the color of the litmus to change.

Advantageously, the variable color material is a silica gel desiccant, and when the electronic cigarette is smoked, the variable color material absorbs saliva and causes the color of the variable color material to change.

Advantageously, the variable color material is blue silica gel desiccant, and the variable color material becomes red when the electronic cigarette is smoked.

Advantageously, the variable color material is orange non-cobalt silica gel desiccant, and the variable color material becomes green when the electronic cigarette is smoked.

An electronic cigarette atomizer is provided which includes a variable color material, and when the electronic cigarette is smoked, the variable color material generates a chemical reaction or a physical change and causes a color of the variable color material to change.

Advantageously, the electronic cigarette atomizer includes a liquid guiding member configured to lead saliva to the variable color material, and one end of the liquid guiding member is in contact with the variable color material.

Advantageously, the variable color material is an inclusion generated by starch and iodine, and when the electronic cigarette is smoked, the starch in the inclusion is decomposed by the salivary amylase in the saliva.

An electronic cigarette-holder is provided which includes a variable color material, and when the electronic cigarette is smoked, the variable color material generated a chemical reaction or a physical change, and causes the color of the variable color material to change.

Advantageously, the cigarette-holder includes a liquid guiding member configured to lead saliva to the variable color material, and one end of the liquid guiding member is in contact with the variable color material.

When implementing the electronic cigarette, the electronic cigarette atomizer and the electronic cigarette-holder of the present invention, the following advantageous effects can be achieved: a variable color material is mounted on the cigarette-holder, when a user is smoking the electronic cigarette, saliva in the mouth of the user or carbon dioxide exhaled by the user will cause the variable color material to generate a chemical reaction or a physical change. Thus, the color (e.g., blue) of the variable color material changes, that is, the color of the cigarette-holder changes. The user can determine whether an electronic cigarette stored in a cigarette box has been smoked by observing color change of a cigarette-holder of the electronic cigarette, which can prevent the condition that a plurality of persons share a same electronic cigarette and further prevent disease transmission, and can improve users' experience.

BRIEF DESCRIPTION OF THE DRAWINGS

The present invention will be further described with reference to the accompanying drawings and embodiments in the following, in the accompanying drawings.

DETAILED DESCRIPTION OF THE PREFERRED EMBODIMENT

To make the technical feature, objective and effect of the present invention be understood more clearly, now the specific implementation of the present invention is described in detail with reference to the accompanying drawings and embodiments.

Figure 1:
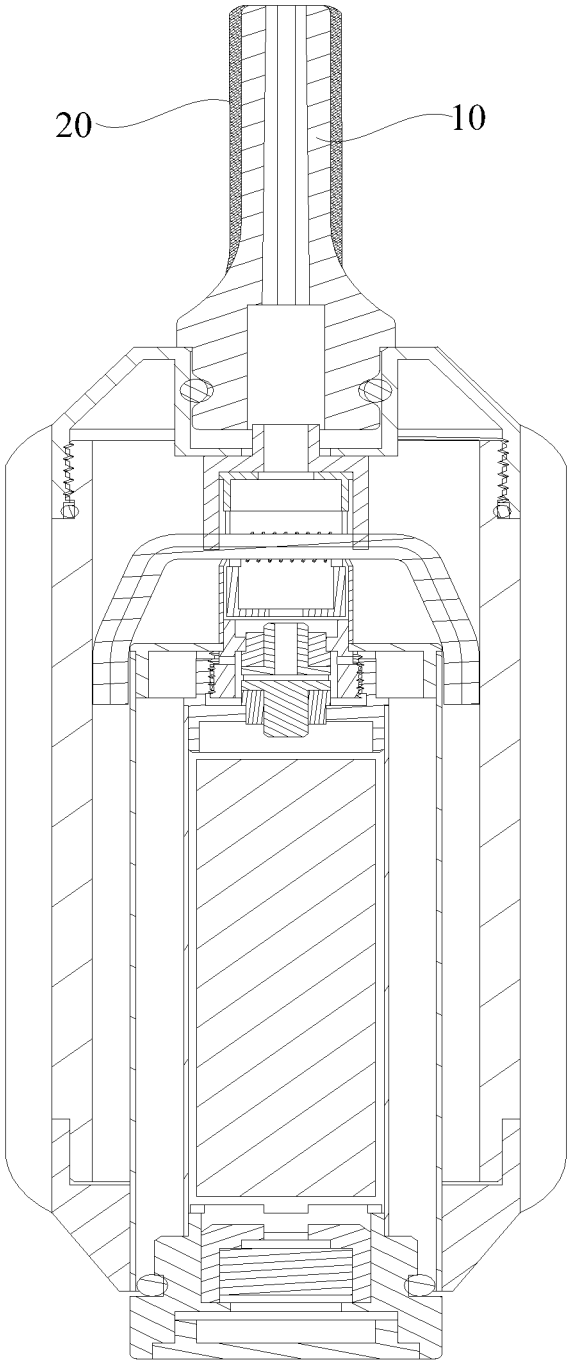
FIG. 1 is a cut-away view of an electronic cigarette of a first embodiment of the present invention.
Figure 2:
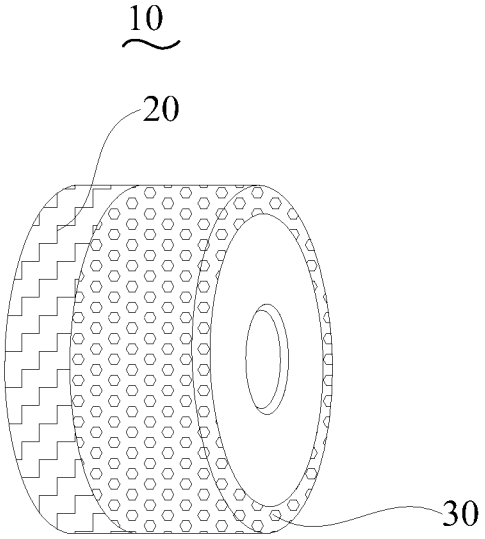
FIG. 2 is a structural schematic view of the electronic cigarette-holder shown in FIG. 1.

As shown in FIGS. 1 and 2, an electronic cigarette provided by a first embodiment of the present invention comprises a cigarette-holder 10. The cigarette-holder 10 includes a variable color material with a changeable color. When a user smokes the electronic cigarette, the variable color material generates a chemical reaction and a physical change and causes the color of the variable color material to change, which enables the user to determine whether an electronic cigarette stored in a cigarette box has been smoked or not easily.

The variable color material forms a variable color layer 20 mounted on the cigarette-holder 10 of the electronic cigarette, and the variable color layer 20 can form patterns and/or words. In the production process, the variable color material is processed to form these beautiful patterns and/or words. Thus, the variable color material can be used to determine whether the electronic cigarette has been smoked, and can also increase the aesthetic feeling of the electronic cigarette. Specifically, the patterns may be plum blossoms, bamboos, landscapes, and so on. The words may be letters, allegorical characters, and so on. To achieve a desired indicative effect, the thickness of the variable color layer 20 ranges from 1 micron to 100 microns. Advantageously, the thickness of the variable color layer is 20 microns.

The variable color layer 20 may be mounted on an outer surface of the cigarette-holder 10 or inside the cigarette-holder 10. Specifically, the variable color layer 20 may be mounted on an outer surface of the cigarette-holder 10 corresponding to the user's mouth, or be mounted inside the cigarette-holder 10. In particular, the variable color layer 20 can be formed on the cigarette-holder 10 by immersion, deposition, spraying or pasting. The cigarette-holder 10 of the electronic cigarette of this embodiment is independent and removable, and is configured as an electronic cigarette-holder. It is understood that the cigarette-holder 10 may be a part of the electronic cigarette in other embodiments, that is, the cigarette-holder 10 may be designed as being integrated with the structure of the electronic cigarette.

As the variable color material is mounted inside the cigarette-holder 10, the cigarette-holder 10 includes a liquid guiding member 30 configured to lead saliva of the user to the variable color material. The liquid guiding member 30 is a hollow cylinder with two open ends, one end of the liquid guiding member 30 extends to a distal end of the electronic cigarette, and the other end of the liquid guiding member 30 is in contact with the variable color material. Thus, the saliva of the user or the gas exhaled by the user is led into the cigarette-holder 10 by the liquid guiding member 30, and contacts the variable color material inside the cigarette-holder 10 to make the color of the variable color material change. The liquid guiding member 30 is made of at least one material selected from sponge, cotton, acetate fiber and nonwoven fabric, and the liquid guiding member 30 is non-toxic, non-polluted, and harmless to people.

When the variable color material is mounted inside the cigarette-holder 10, the portion of the cigarette-holder 10 that corresponds to the variable color material is configured to be transparent, so that the user can watch the color change of the variable color material inside the cigarette-holder 10 from a side of the electronic cigarette.

Embodiment 1

In the electronic cigarette of the first embodiment of the present invention, the variable color material mounted on the cigarette-holder 10 is an inclusion formed by starch and iodine. The inclusion is inside the cigarette-holder 10, that is, the inclusion formed by starch and iodine isn't exposed on the outer surface of the cigarette-holder 10 corresponding to the user's mouth. The cigarette-holder 10 further includes the liquid member 30. When the electronic cigarette is smoked, the saliva of the user led into the variable color material by the liquid guiding member 30. The starch of the inclusion is decomposed by salivary amylase in the saliva, and the color of the variable color material changes, so that persons are reminded that the electronic cigarette has been smoked before. The reason of starch-iodine discoloration is not a chemical reaction but another kind of interaction generated between the starch and the iodine. Specifically, each spiral central hole of the starch can just accommodate an iodine molecule, which generates a blue-black inclusion formed by the starch and the iodine due to Van der Waals force. Thus, when the starch is decomposed, the color of the inclusion generated by starch and iodine changes. As the variable color material is mounted inside the cigarette-holder 10, the portion of the cigarette-holder 10 corresponding to the variable color material is transparent, so that persons can watch the color change of the variable color material inside the cigarette-holder 10 from a side of the electronic cigarette.

As the variable color material is an inclusion generated by amylose and iodine, the variable color material is blue, that is, the cigarette-holder 10 is blue. When the user smokes the electronic cigarette, salivary amylase in the saliva of the user can decompose the amylose, and the blue variable material becomes transparent. Thus, the user can determine whether an electronic cigarette in a cigarette box has been smoked.

As the variable color material is an inclusion generated by amylopectin and iodine, the variable color material is purple, that is, the cigarette-holder 10 is purple. When the user smokes the electronic cigarette, salivary amylase in the saliva of the user can decompose the amylopectin, and the purple variable color material become transparent. Thus, the user can determine whether an electronic cigarette in a cigarette box has been smoked.

Embodiment 2

In an electronic cigarette of a second embodiment of the present invention, the variable color material mounted on the cigarette-holder 10 is a colorful sugar, and the variable color material is mounted on an outer surface of the cigarette-holder 10 corresponding to the user's mouth. When the user smokes the electronic cigarette, the colorful sugar melts and is swallowed by the user. Because the variable color material is swallowed, the cigarette-holder 10 becomes transparent, and thus the user can easily determine whether the electronic cigarette has been smoked. The sugar is natural edible sugar, such as one or more selected from maltose, stevioside, sucrose, and glucose, which ensures "green is healthy". Furthermore, the variable color material can be designed as various types of variable color layers 20, and these variable color layers 20 can have certain patterns and shapes in order to increase the beauty and meet needs of different users.

The users can easily determine whether the electronic cigarette of this embodiment has been smoked, and the electronic cigarette of this embodiment is beautiful. The outer surface of the cigarette-holder 10 can be designed to be in various colors, and users feel sweet when they smoke the electronic cigarette of this embodiment, which enables the users to have a different kind of enjoyment and improves the experience of the users.

It can be understood that other kinds of edible and colorful variable color material, such as algae, vitamins, fruits, and so on, can also be mounted on the outer surface of the cigarette-holder 10. Thus, the user can determine whether the electronic cigarette has been smoked, and the user's experience can be improved.

Embodiment 3

In an electronic cigarette of a third embodiment of the present invention, the variable color material mounted on the cigarette-holder 10 is litmus. The litmus is an indicator, and under different actions of acid solution and alkali solution, the litmus generates conjugate structure changes, and the color of the litmus changes. Specifically, the litmus becomes red in acid, and becomes blue in alkaline. In this embodiment, the litmus is mounted inside the cigarette-holder 10 without the contact with the user's month. The cigarette-holder 10 is also provided with the liquid guiding member 30, wherein the liquid guiding member 30 is porous material. When the user smokes the electronic cigarette, the liquid guiding member 30 can lead carbon dioxide exhaled by the user and saliva in the user's mouth into the cigarette-holder 10, and the carbon dioxide or the saliva contacts the litmus to make the litmus become red. Thus, when the user finds that the cigarette-holder 10 of the electronic cigarette becomes red, the user can determine that the electronic cigarette has been smoked, and the electronic cigarette is prevented from being smoked by other persons.

Embodiment 4

In an electronic cigarette provided by a fourth embodiment of the present invention, the variable color material mounted on the cigarette-holder 10 is silica gel desiccant. The silica gel desiccant is insoluble in water and any other solvent, non-toxic, odorless, and chemically stable. The silica gel desiccant does not react with any substance except strong alkali and hydrofluoric acid, and has a strong moisture absorption function. Therefore, the silica fen desiccant is a highly active adsorption material, and can be mounted on the surface of the cigarette-holder 10 or inside the cigarette-holder 10. Because the cigarette-holder 10 of this embodiment further includes a liquid guiding member 30, the electronic cigarette received inside a cigarette box needs to be sealed by vacuum packaging. When the user takes the electronic cigarette out and smokes, the saliva of the user is led into the electronic cigarette by the liquid guiding member 30 and contacts the silica gel desiccant. Since the color of the silica gel desiccant absorbing water will change, the user can determine whether the electronic cigarette has been smoked by observing whether the color of the silica gel desiccant changes.

As the variable color material is blue silica gel desiccant, the cigarette-holder 10 of the electronic cigarette is blue when it has not been smoked. After the electronic cigarette has been smoked, the blue silica gel desiccant becomes red because of absorbing saliva of a user. Thus, the user can determine whether an electronic cigarette inside a cigarette box has been smoked.

As the variable color material is orange non-cobalt silica gel desiccant, the cigarette-holder 10 of the electronic cigarette is orange when it has not been smoked. After the electronic cigarette has been smoked, the orange non-cobalt silica gel desiccant becomes green because of absorbing saliva of a user. Thus, the user can determine whether an electronic cigarette inside a cigarette box has been smoked.

It can be understood that the electronic cigarette of the present invention can be formed by connecting an atomizer with a battery pole, or be made up of an outer tube and atomizing assemblies and battery components accommodated in the outer tube, and can also be formed by connecting the cigarette-holder 10 with an atomizer and a battery detachably.

Figure 3:
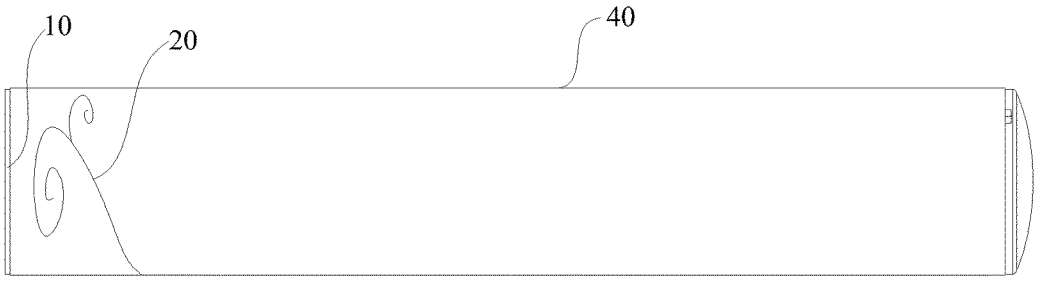
FIG. 3 is a cut-away view of an integrated electronic cigarette of a second embodiment of the present invention.

As shown in FIG. 3, an electronic cigarette comprises a sleeve 40, and atomizing assemblies and battery components accommodated in the sleeve 40. One end of the sleeve 40 itself is the cigarette-holder 10, and the end of the sleeve 40 serving as the cigarette-holder 10 includes the variable color material with a changeable color, and the variable color material forms the variable color layer 20 with patterns. When a user smokes the electronic cigarette, the variable color layer 20 generates a chemical reaction or a physical change, which causes the color of the variable color layer 20 to change. The variable color layer 20 can be formed by the above-described inclusion of starch and iodine, colorful edible sugar, litmus, silica gel desiccant, and so on, and the specific color principles are unnecessary to go into details here. In this embodiment, the sleeve 40 is transparent, and the variable color layer 20 is mounted inside the sleeve 40. The end of the sleeve 40 serving as the cigarette-holder 10, includes a liquid guiding member (not shown) used to lead saliva of a user to the variable color layer 20. The user can determine whether the electronic cigarette has been smoked by observing the color change of the variable color layer 20 with patterns.

In summary, the present invention provides an electronic cigarette, wherein the cigarette-holder 10 of the electronic cigarette includes a variable color material. When a user smokes the electronic cigarette, saliva in the user's mouth or carbon dioxide exhaled by the user can cause the variable color material to generate a chemical reaction or a physical change. Thus, the color of the variable color material changes, that is, the color of the cigarette-holder 10 changes. The user can determine whether the electronic cigarette has been smoked or not by observing the color change of the cigarette-holder 10, which can prevent a same electronic cigarette from being shared by a plurality of persons and avoid transmission of many diseases, and the user's experience can be improved.

Figure 4:
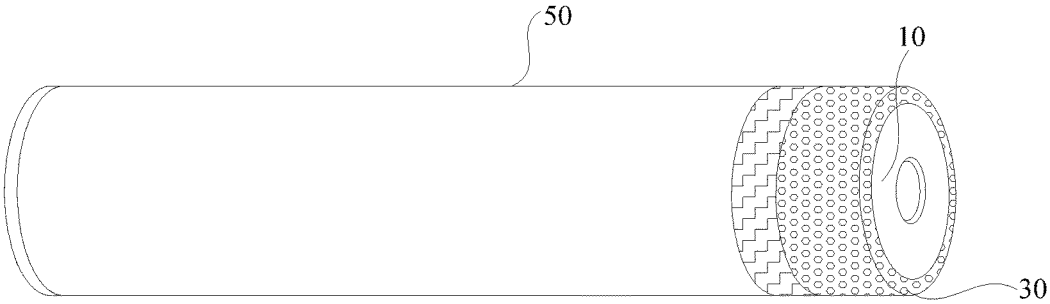
FIG. 4 is a structural schematic view of an electronic cigarette atomizer of a preferred embodiment of the present invention.

As shown in FIG. 4, the present invention further provides an electronic cigarette atomizer. One end of the electronic cigarette atomizer is designed to be the cigarette-holder 10. The end of the atomizer serving as the cigarette-holder 10 includes a variable color material. When a user smokes the electronic cigarette, the variable color material can generate a chemical reaction or a physical change, and a color of the variable color material is caused to change. The atomizer further includes the liquid guiding member 30, and one end of the liquid guiding member 30 is in contact with the variable color material. Specifically, the variable color material can be the above-described inclusion of starch and iodine, colorful edible sugar, litmus, silica gel desiccant, and so on. In addition, an outer case 50 of the electronic cigarette is configured to be transparent. Since the outer case 50 is transparent, the user can watch the color change of the cigarette-holder 10 through the outer case 50, and thereby determine whether the electronic cigarette has been smoked.

While the embodiments of the present invention are described with reference to the accompanying drawings above, the present invention is not limited to the above-mentioned specific implementations. In fact, the above-mentioned specific implementations are intended to be exemplary not to be limiting. In the inspiration of the present invention, those ordinary skills in the art can also make many modifications without breaking away from the subject of the present invention and the protection scope of the claims. All these modifications belong to the protection of the present invention.

What is claimed is:

1. An electronic cigarette comprising a cigarette-holder, wherein, the cigarette-holder includes a variable color material; and when the electronic cigarette is smoked, the variable color material generates a chemical reaction or a physical change and causes a color of the variable color material to change; wherein the variable color material is an inclusion generated by starch and iodine, and when the electronic cigarette is smoked, the starch in the inclusion is decomposed by salivary amylase in saliva and causes the color of the variable color material to change, wherein the variable color material is arranged inside the cigarette-holder, the portion of the cigarette-holder that corresponds to the variable color material is configured to be transparent so that the user can watch the color change of the variable color material inside the cigarette-holder from a side of the electronic cigarette, the variable color material forms a variable color layer, and the variable color layer forms patterns and/or words, wherein a thickness of the variable color layer ranges from 1 micron to 100 microns; wherein the variable color layer is formed by immersion, deposition, spraying or pasting; wherein the cigarette-holder further includes a liquid guiding member configured to lead saliva to the variable color material the liquid guiding member is a hollow cylinder with two open ends, one end of the liquid guiding member extends to a distal end of the electronic cigarette, and the other end of the liquid guiding member is in contact with the variable color material;

wherein the liquid guiding member is made of at least one material selected from sponge, cotton, acetate fiber, and nonwoven fabric; and wherein the cigarette-holder is designed as being integrated with a structure of the electronic cigarette.

2. The electronic cigarette according to claim 1, wherein, the variable color material is an inclusion generated by amylose and iodine, and the variable color material is blue; and when the electronic cigarette is smoked, the amylose of the variable color material is decomposed by the salivary amylase, and the blue variable color material becomes transparent.

3. The electronic cigarette according to claim 1, wherein, the variable color material is an inclusion generated by amylopectin and iodine, and the variable color material is purple; and when the electronic cigarette is smoked, the amylopectin of the variable color material is decomposed by the salivary amylase, and the purple variable color material becomes transparent.

4. The electronic cigarette according to claim 1, wherein, the variable color material is a colorful sugar, and the colorful sugar melts when the electronic cigarette is smoked.

5. The electronic cigarette according to claim 4, wherein, the sugar is made up of at least one selected from maltose, stevioside, sucrose, and glucose.

6. The electronic cigarette according to claim 1, wherein, the variable color material is litmus, and when the electronic cigarette is smoked, carbon dioxide exhaled by a user causes the color of the litmus to change.

7. The electronic cigarette according to claim 1, wherein, the variable color material is a silica gel desiccant, and when the electronic cigarette is smoked, the variable color material absorbs saliva and causes the color of the variable color material to change.

8. The electronic cigarette according to claim 7, wherein, the variable color material is blue silica gel desiccant, and the variable color material becomes red when the electronic cigarette is smoked.

9. The electronic cigarette according to claim 7, wherein, the variable color material is orange non-cobalt silica gel desiccant, and the variable color material becomes green when the electronic cigarette is smoked.

10. An electronic cigarette-holder, wherein, the cigarette-holder includes a variable color material, and when the electronic cigarette is smoked, the variable color material generated a chemical reaction, and causes the color of the variable color material to change;

wherein the variable color material is an inclusion generated by starch and iodine, and when the electronic cigarette is smoked, the starch in the inclusion is decomposed by salivary amylase in saliva and causes the color of the variable color material to change;

wherein the variable color material is arranged inside the cigarette-holder, the portion of the cigarette-holder that corresponds to the variable color material is configured to be transparent, so that the user can watch the color change of the variable color material inside the cigarette-holder from a side of the electronic cigarette, the variable color material forms a variable color layer, and the variable color layer forms patterns and/or words;

wherein a thickness of the variable color layer ranges from 1 micron to 100 microns;

wherein the variable color layer is formed by immersion, deposition, spraying or pasting;

wherein, the cigarette-holder further includes a liquid guiding member configured to lead saliva to the variable color material, the liquid guiding member is a hollow cylinder with two open ends, one end of the liquid guiding member extends to a distal end of the electronic cigarette, and the other end of the liquid guiding member is in contact with the variable color material;

wherein the liquid guiding member is made of at least one material selected from sponge, cotton, acetate fiber, and nonwoven fabric; and wherein the cigarette-holder is designed as being integrated with a structure of the electronic cigarette.

* * * * *